United States Patent [19]

Fennell et al.

[11] Patent Number: 4,927,198

[45] Date of Patent: May 22, 1990

[54] LOCKING DEVICE FOR WINDOWS/SLIDING DOORS

[76] Inventors: Cheryl A. Fennell, 14 Barberry Ct., Largo, Md. 20772; Kathy L. Fennell, 6504 W. Forest Rd., #201, Landover, Md. 20785

[21] Appl. No.: 293,061

[22] Filed: Jan. 3, 1989

[51] Int. Cl.[5] ..... E05C 17/30

[52] U.S. Cl. ..... 292/306; 292/338; 292/DIG. 47; 16/66; 49/450; 49/362

[58] Field of Search ..... 49/404, 450, 449, 360, 49/362; 16/193, 197, 66, 84; 292/305, 306, 338, 339, DIG. 47, 262, 263, DIG. 46

[56] References Cited

U.S. PATENT DOCUMENTS

| | | | |
|---|---|---|---|
| 350,460 | 10/1886 | Leslie | 292/306 |
| 2,114,910 | 4/1938 | Shattuck | 292/305 |
| 3,136,290 | 6/1964 | Bailey et al. | 292/305 |
| 3,278,979 | 10/1966 | Clement | 16/66 |
| 3,566,434 | 3/1971 | Grinsteiner | 16/66 |
| 3,637,247 | 1/1972 | Manion | 292/262 |
| 4,079,479 | 3/1978 | Clement | 49/449 |
| 4,152,018 | 5/1979 | Cantrell | 292/305 |
| 4,792,169 | 12/1988 | Petry | 292/305 |

*Primary Examiner*—Gary L. Smith
*Assistant Examiner*—Eric K. Nicholson

[57] ABSTRACT

A safety device for sliding windows or doors comprising a hydraulic cylinder assembly including a piston and piston rod wherein the piston rod is pivotally secured at its lower end and is made adjustable so that the sliding window or door may be moved from a fully closed position to variable open positions.

7 Claims, 2 Drawing Sheets

FIG 3
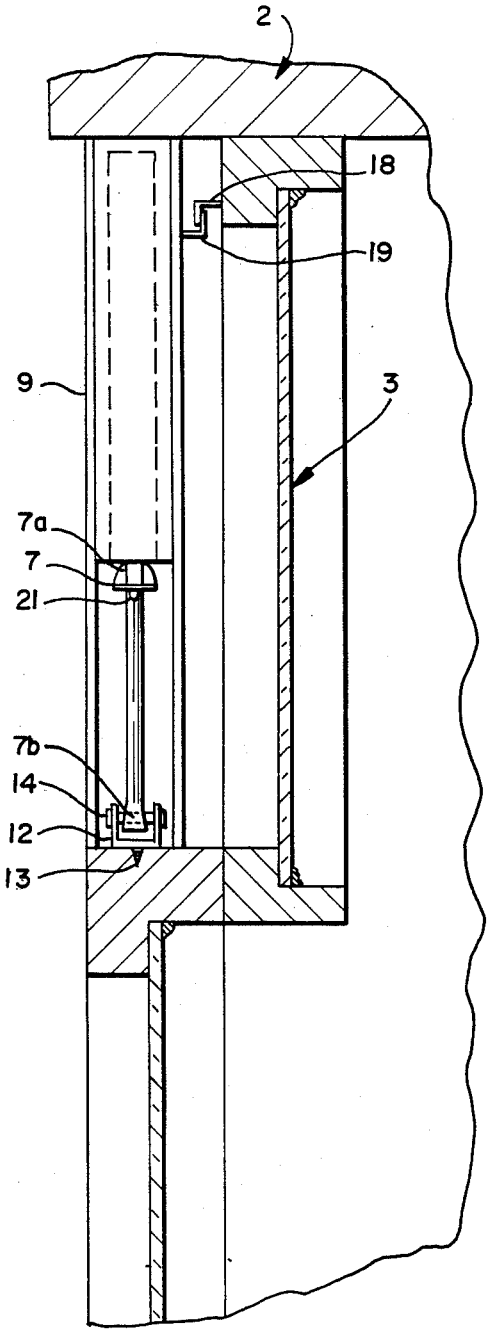
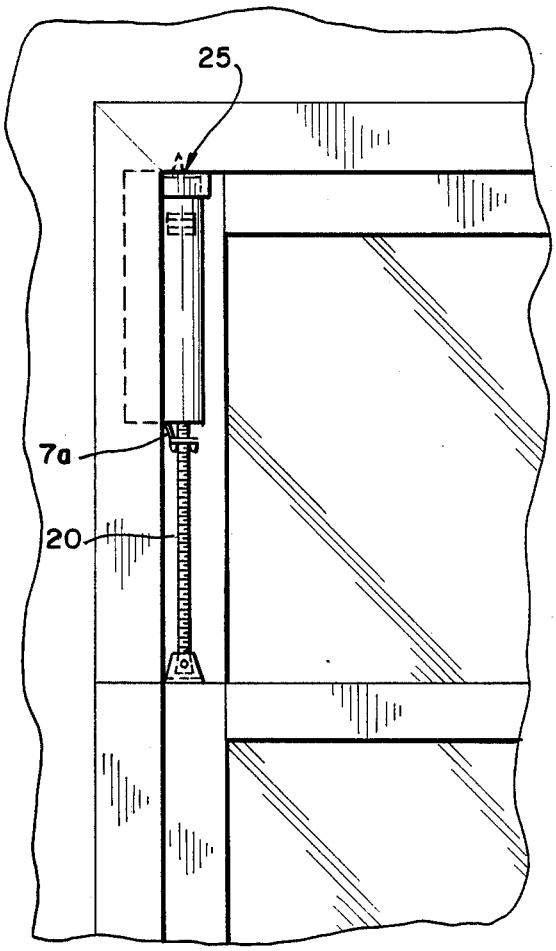
FIG 4
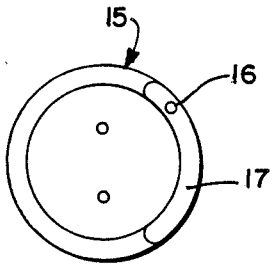
FIG 5
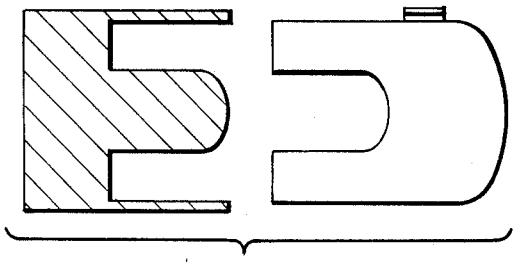
FIG 6

LOCKING DEVICE FOR WINDOWS/SLIDING DOORS

BACKGROUND AND SUMMARY OF INVENTION

This invention is directed to safety devices for sliding windows or sliding doors. There is considerable prior art of this type as exemplified by U.S. Pat. Nos. 912,458, 1,266,804, 3,420,001, 3,471,189, 3,486,781, 3,512,821, 3,554,592, 3,816,967, 4,005,889. As can be seen devices embody the principle of using an adjustable means so that the sliding window or door can be, if necessary, partially opened. Additionally, a number of these fasteners are designed to be pivotable so that the locking device can be swung to an inoperative position as for example in 3,471,189.

The safety device of the present invention is also adjustable as well as easily removable but acts on a different principle. Essentially the locking device utilizes an hydraulic door closer wherein the cylinder thereof is mounted to an adjacent channel of the window frame and its piston rod is mounted on a bracket on the upper end of the lower window. Adjustability is obtained by a simple movement of the washer which is movable on the piston rod. Unlike the door closer however, the normal position of the piston rod is in full extension. Additionally, while the locking device of this invention is intended to be adaptable to homes already in use, it also is contemplated that it be fitted into newly constructed homes. In this instance the locking device and the channel window frame will be constructed as a single entity, and the channel frame carrying the locking device adjacent the upper window will be separate from the channel frame adjacent the lower window. As an added precaution the cylinder of the locking device will have affixed its upper end a mechanism that will limit movement of the upper window as well.

BRIEF DESCRIPTION OF THE DRAWINGS

FIG. 3 is a plan view on line 3—3

FIG. 4 is a sectional view showing an embodiment wherein the locking assembly is removably fitted into the window frame 2 and the channel frame and cylinder are separate structures.

FIG. 5 is a detail of the cap plate for releasably holding the cylinder.

FIG. 6 is a plan view similar to FIG. 3 showing the locking device and channel window frame as separate elements.

DESCRIPTION OF THE PREFERRED EMBODIMENT

Figure 1:
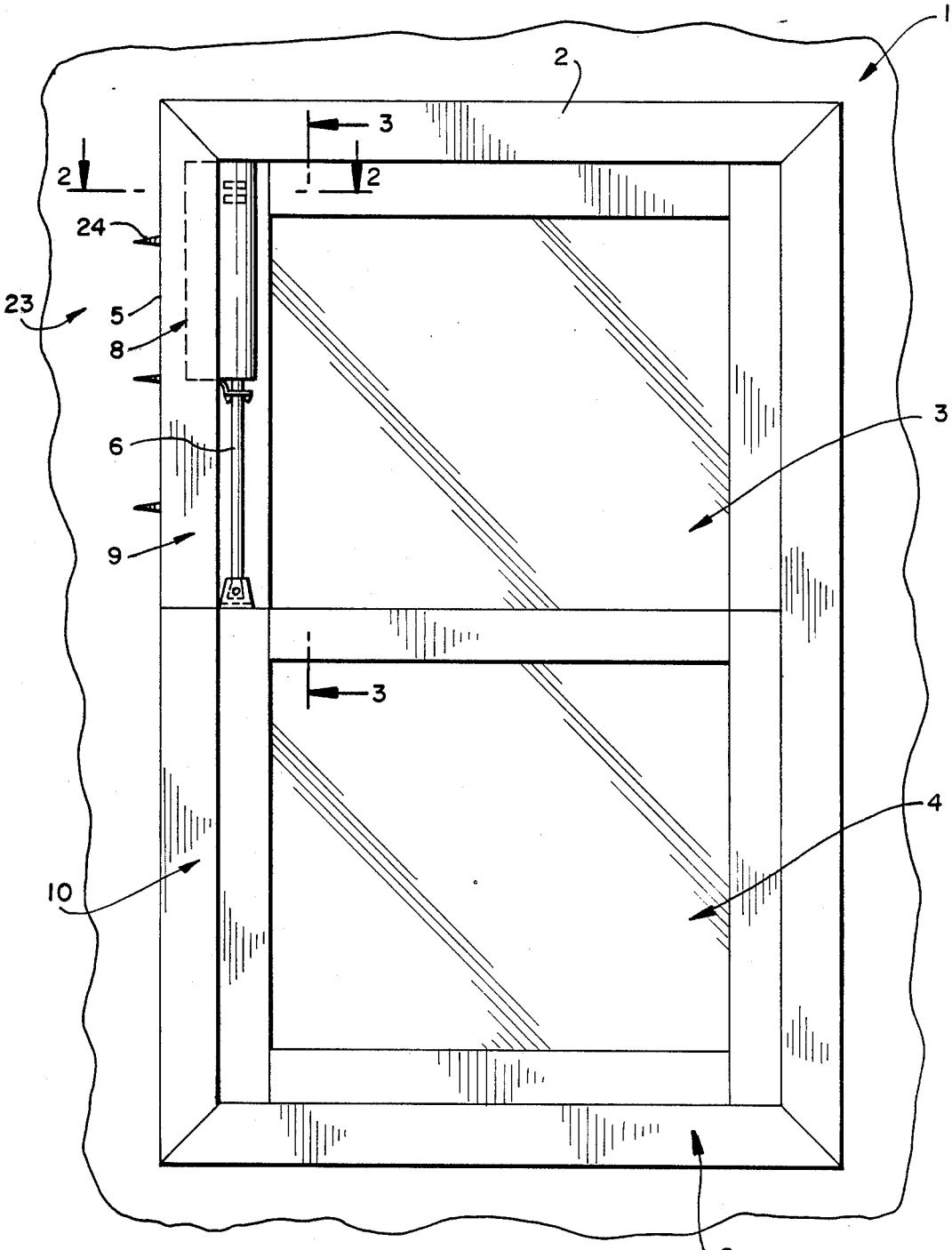
FIG. 1 is a frontal view of a closed window with the locking device fitted in the left channel window frame as a single unit.

With respect to FIG. 1 numeral 1 refers to a window assembly comprising a frame 2 having respectively upper and lower windows 3 and 4. The locking assembly device is referred to as number 5. A hydraulic door closer similar to that shown in U.S. Pat. No. 3,413,679 is used as the locking device and comprises locking assembly device 5. The locking assembly 5 is the pneumatic spring type having a cylinder 8 filled with a compressed fluid and a piston rod 6 connected to a piston element not shown. While this locking assembly is of the type used on many storm doors as door closers it differs in arrangement. Unlike the storm door wherein the normal position of the piston rod is biased inwardly, the rod 6 on the window 3 will be outwardly biased when the windows are in closed position. Another distinction of this locking assembly 5 is that both the cylinder 8 and rod 6 are correspondingly longer so as to be suitable for windows and doors. The diameter of the piston rod 6 is also about one and a half times the size of the conventional rod. A lock washer 7 as illustrated in FIG. 1 is freely movable along the piston rod 6 and enables adjustment of the rod 6 to a multiple number of positions. The washer has a flange 7*a* facing the lower end of the cylinder and acting as a stop when the washer moves along the rod. To facilitate ease of hanlding the washer 7 has winged extensions 21 which are mounted on the far side of the washer away from the lower end of the cylinder. As an alternative method for adjustment, the rod 6 may have a portion 20 threaded and the ring washer 7 tapped so as to engage the threads on the rod and by rotation of the washer 7 alter the position of the rod. The lower end of the piston rod 6 has a flattened portion 7*b* and is perforated. A bracket 12 is fastened to the upper end of the lower window 4 by screws 13. A pin 14 passes through the perforated end of the rod 6 to mount the rod 6 to the upper end of the lower window 4.

Figure 2:
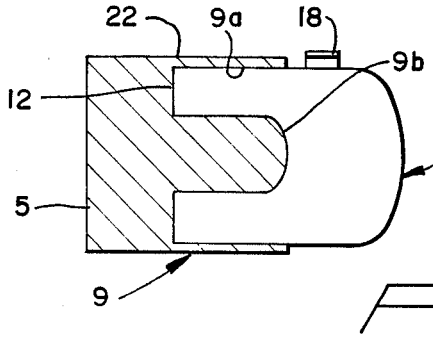
FIG. 2 is a sectional view taken on line 2—2 of FIG. 1.

As seen in FIG. 2 extending laterally from the cylinder 8 and affixed to a window channel frame 9 having grooves 9*a* and a protuberance 9*b* and coextensive therewith are a pair of legs 12 in the form of a U-shape. The frame 9 and locking assembly 5 can be made as a unit 22. Unit 22 is separate and distinct from lower window channel frame 10. The unit is mounted to adjoining structure 23 by screws 24 and window channel frame 9 is aligned to fit precisely over lower window channel frame 10, albeit lower channel frame 10 does not have the protuberance of upper channel frame 9 or separate grooves.

On the other hand, the locking assembly device 5 can be a separate entity from the channel frame. In this instance the U-shaped legs 12 releasably fit into the grooves 9*a* of the window channel frame 9 and the cylinder 8 of the locking device 5 is releasably held in a circular cap 15 that is screwed with screws 25 to frame 2 at its upper end and has an arcuate hinged plate 17 to clamp the upper end of the cylinder 8 to enable ready release. As seen in FIG. 4 the cylindrical cap 15 is hinged at its right by rivet 16. To prevent upper window unit 3 from being pried to move downwardly, the upper window 3 has an angle 18 affixed at its upper end adjacent the rear of cylinder 8 of the locking device 5. A corresponding angle 19 is fastened to the rear of the cylinder 8 that grips angle 18 on window unit 3 to deter downward movement. Where the locking device 5 is nested in the channel frame, the locking device can be easily removed by opening the arcuate plate 17 at the top of the frame 2 and removing pin 14 at the bracket 12.

While the invention has illustrated utility in a window, it obviously could be adapted for use in a sliding door assembly as well. It can be seen from all of the above description that an invention has been created that is readily adaptable in houses to be or in the conventional use of fitting to a house in being and is one that provides a satisfactory alternative for adjustment than the devices shown by the prior art.

I claim:

1. A locking device for windows in overlapping relationship including a vertically moveable lower window and a vertically moveable upper window that comprises an upper window frame and a lower window frame, a vertically upstanding pneumatic cylinder having an upper end and a lower end and a piston rod member at said lower end moveable with respect thereto, means pivotally securing said piston rod at its lower end to the upper end of said lower window, a first lower vertical channel frame adjacent and aligned with one side of the lower window and a second upper vertical channel frame having grooves and aligned and coextensive with said lower channel frame and adjacent said one side of the upper window, said pneumatic cylinder having laterally positioned legs forming a U-shaped member that extends longitudinally there along, the legs being adapted to be received in said grooves of said upper channel frame and secured thereto to said upper channel frame and said locking device constituting an integrated unit, a washer mounted on said rod and having a flange facing a lower end of said cylinder and means for moving said washer along said rod so as to adjustably limit movement of said piston rod with respect to said cylinder, thereby controlling movement of said lower window.

2. A locking device as in claim 1 wherein said means for moving the washer includes winged extensions mounted on the far side of the washer away from the lower end of the cylinder.

3. A locking device as in claim 2 wherein a portion of said piston rod is threaded and said flange washer threadably engages threads on said rod to rotate said washer.

4. A locking device as in claim 1 wherein said upper channel frame and said locking device are separate units, and said means for securing said lower end of the rod includes a bracket mounted adjacent said channel frame on the upper end of the lower window, said rod having a perforated flat end for insertion within the bracket and a pin for pivotally connecting said rod to said bracket.

5. A locking device as in claim 4 wherein means secured to said upper window frame releasably secures said upper end of the cylinder to said frame and means for preventing downward movement of said upper window.

6. A locking device as in claim 5 wherein said releasable securing means is a cylindrical cap having an arcuate plate pivotably mounted on the side of the cap wherein said means for preventing said downward movement includes an angle affixed to said upper window at its upper end for gripping a corresponding angle fastened to the rear of the cylinder.

7. A pneumatic locking device for windows in overlapping relationship including an upper and lower moveable window comprising a lower channel frame and an aligned upper channel frame integral with a pneumatic cylinder, said cylinder having a threaded rod extending therefrom said rod having a flattened perforated lower end mounted within a bracket affixed to the upper end of said lower window adjacent said upper channel frame said rod having a washer mounted thereon for rotation, a flanged member on said washer facing inwardly towards the lower end of the cylinder and winged extensions on said washer facing outwardly, said rotation of the washer enabling movement of the rod with respect to the cylinder to a multiple number of positions, thereby controlling movement of said lower window.

* * * * *